US005697767A

United States Patent [19]

Bissell et al.

[11] Patent Number: 5,697,767

[45] Date of Patent: Dec. 16, 1997

[54] INTEGRATED TURBINE AND PUMP ASSEMBLY

[75] Inventors: William R. Bissell, Westlake Village; Maynard L. Stangeland, Thousand Oaks, both of Calif.

[73] Assignee: Boeing North American, Inc., Seal Beach, Calif.

[21] Appl. No.: 324,273

[22] Filed: Oct. 14, 1994

Related U.S. Application Data

[63] Continuation-in-part of Ser. No. 240,943, May 11, 1994, abandoned, which is a continuation of Ser. No. 48,566, Apr. 16, 1993, abandoned, which is a continuation of Ser. No. 749,090, Aug. 23, 1991, abandoned.

[51] Int. Cl.[6] ..... F04B 17/00

[52] U.S. Cl. ..... 417/350; 417/406; 417/409

[58] Field of Search ..... 417/406, 407, 417/408, 409, 410, 350

[56] References Cited

U.S. PATENT DOCUMENTS

| | | | |
|---|---|---|---|
| Re. 24,810 | 4/1960 | Buchi | 417/406 |
| 2,175,997 | 10/1939 | Saxe . | |
| 3,741,676 | 6/1973 | Silvern et al. | 415/52 |
| 3,784,324 | 1/1974 | Staveren | 417/406 |
| 3,976,390 | 8/1976 | Silvern et al. | 415/53 |
| 4,067,665 | 1/1978 | Schwartzman | 417/245 |
| 4,155,684 | 5/1979 | Curiel et al. | 417/409 |
| 4,255,095 | 3/1981 | Goulvestre et al. | 417/406 |
| 4,260,339 | 4/1981 | Lofts | 417/406 |
| 4,646,207 | 2/1987 | Catterfeld et al. | 417/410 |
| 4,865,529 | 9/1989 | Sutton et al. | 417/409 |

FOREIGN PATENT DOCUMENTS

| | | | |
|---|---|---|---|
| 3838143 | 5/1990 | Germany | 417/407 |

*Primary Examiner*—Michael Koczo

*Attorney, Agent, or Firm*—Harry B. Field; Steven E. Kahm

[57] ABSTRACT

A turbopump assembly comprises first pump section housing, a second pump section housing, and a common rotatable shaft positioned within said housings which further define First and second pump sections. The housings and rotatable shaft also define internal manifolds selectably positioned in the first pump section and second pump section whereby said first pump section, second pump, and internal manifolds form an integrated turbine and dual pump configuration.

14 Claims, 8 Drawing Sheets

INTEGRATED TURBINE AND PUMP ASSEMBLY

This is a continuation-in-part of application Ser. No. 08/240,943 filed on May. 11, 1994, now abandoned.

BACKGROUND OF THE INVENTION

1. Field of the Invention

The present invention relates to high-speed turbopump assemblies and more particularly, to an integrated turbine and pump design whereby the conventional design having separate components to make up the pump or compressor section and the turbine section, and associated bearing and seal components are eliminated in favor of a unitary turbopump assembly consisting of a one piece rotor installed in a two piece housing.

2. Description of Related Art

Prior art turbomachinery provides inducer, axial flow, and centrifugal type pumps or compressors which are coupled to an axial or radial flow turbine as a source of power. The pumps can be single stage or multistage depending on the discharge pressure or head required and the density of the fluid being pumped. The turbines can be single stage or multistage and can be of an impulse or reaction type depending on the energy level available in the work fluid. The pump and turbine can be separate units connected together by a coupling for torque transmission or can be mounted on a common shaft. Typically, the rotor is an assembly of numerous parts consisting of pump inducers and impellers, turbine discs or wheels, bearings journals and dynamic seal mating rings; all of which are assembled together on a common shaft through splines or curving couplings and preloaded together through the use of retainer nuts and bolts to make up the rotor assembly. The housing consists of numerous parts, including inlets, interstage diffusers, volutes, turbine manifolds, nozzles, bearings, labyrinth seal and dynamic seal; all bolted together with appropriate static seals to make up the turbopump housing. The rotor components are assembled for balancing purposes but then must be disassembled to facilitate assembly of the turbopump, because the housing components have smaller internal diameters than the maximum outer diameters of the rotor components.

A typical state of the art liquid hydrogen turbopump, of the type discussed above, has housing components that radially penetrate the rotating assembly outer diameter, to a diameter less than that of either the pump impellers or the turbine rotors, at least four times between the first pump impeller and the last turbine rotor. The reasons for these radial penetrations are (a) the diffuser type utilized, (b) the pump interstage flow path utilized, and (c) the low surface speed limitations of conventional bearings and seals. As a result, at least six major rotating assembly parts, and six major housing parts, are required to permit the unit to be assembled and disassembled. In addition, the large depth of the radial penetrations results in a rotating assembly that is quite flexible and, therefore is subject to operation in the range of several flexural critical speeds. This large number of parts, combined with the critical speed limitations, results in a unit that is costly to assemble and maintain, and that is difficult to operate over a wide throttling range. In addition, the rotational speed limitations of the conventional bearings and seals results in a unit that is relatively large and heavy.

For example, U.S. Pat. No. 4,482,303 of Nov. 13, 1984 provides a turbo-compressor apparatus having the turbine section and the compressor section back-to-back. A stationary or non-rotating shaft axially supported in the apparatus supports an anti-friction bearing which, in turn, rotationally supports a rotor assembly which has a turbine wheel disposed within the turbine section and a compressor impeller disposed within the compressor section.

U.S. Pat. No. 4,260,339 of Apr. 7, 1981 defines a turbo compressor apparatus including housing means, rotor means housed within the housing means, fixed shaft means, anchorage means fixedly anchoring the shaft means to the housing means, and bearing means axially and radially locating the rotor means for rotation with respect to the shaft means.

Finally, U.S. Pat. No. 4,255,095 of Mar. 10, 1991 describes a turbine-pump unit characterized in that the pump and the turbine are coupled together at their high-pressure end.

OBJECTS OF THE INVENTION

Accordingly, it is an object of the present invention to provide a simplified turbopump design typically having a single integral rotating element and two major housing elements plus ducting.

Another object of the present invention is to provide a turbopump design having a very rigid rotating element whereby flexural critical speeds are eliminated from the operating speed range.

SUMMARY OF THE INVENTION

All of these and other objects are achieved by the present invention which provides a turbopump assembly consisting of a first pump section, a second pump section, and a turbine section. The objectives of a minimum number of parts, and a rotating element that is free of flexural critical speeds, are achieved by designing to minimize the number of penetrations of the rotating element by the stationary housing. This is accomplished by (a) placing the centrifugal pump inlets at the ends of the rotating element, (b) combining the bearing and seal functions into single components that are placed at the same diameter as the centrifugal pump impellers, (c) placing the pump flow diffusers and flow collectors at diameters greater than those of the centrifugal impellers (d) placing the turbine rotor between the pump elements at a diameter that approaches, or even exceeds, that of the centrifugal pump impellers, and (e) integrating the turbine inlet and exit manifolds and pump inlets and volutes into a two piece housing.

The foregoing and other objects, features and advantages of the present invention will become more apparent in light of the following detailed description of the embodiments thereof as illustrated in the accompanying drawings.

BRIEF DESCRIPTION OF DRAWINGS

For the purpose of illustrating the invention, there is shown in the drawings embodiments which are presently preferred, it being understood, however, that the invention is not limited to the precise arrangements shown.

FIG. 9 is a cross-sectional view of a turbopump assembly having a single stage centrifugal pump and an axial flow turbine utilizing the present invention teachings.

DETAILED DESCRIPTION OF THE PREFERRED EMBODIMENTS

Figure 1:
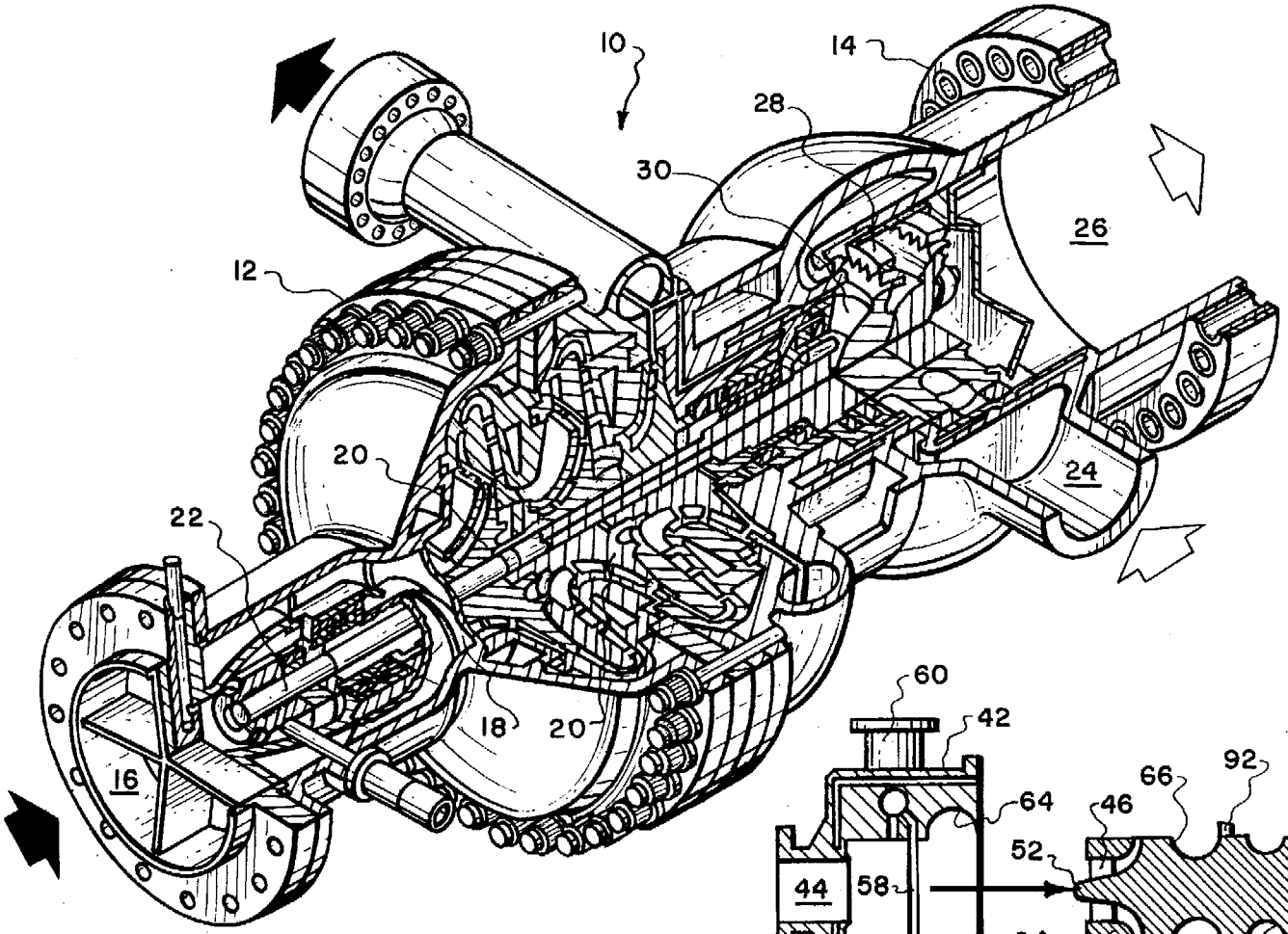
Fig. 1. PRIOR ART
FIG. 1 is a cross-sectional oblique view of a turbopump assembly as is known in the prior art.

Referring now to the drawings, wherein like numerals indicate like elements, there is shown in FIG. 1 a turbopump assembly constructed in accordance with the prior art.

As depicted in FIG. 1, prior turbopump assembly 10 is provided with a forward three stage pump section 12 and an aft two stage turbine section 14. Forward pump section 12 includes a fluid inlet 16, inducer 18, and three impeller stages 20. Common shaft 22 is associated with forward pump section 12 and aft turbine section 14 of assembly 10. Aft turbine section 14 is also provided with a turbine fluid inlet 24, turbine fluid outlet 26, turbine blades 28 and turbine disc 30. The method of operation of turbopump assembly 10 is characterized by a functioning of the aft turbine section 14 by the introduction of working fluid via 24 which causes the functioning of turbine blades 28 which in turn rotate shaft 22. Rotating shaft 22 functions impellers 20 located on shaft 22 within the pump section 12 of assembly 10 and induces fluid to flow via fluid inlet 16 into pump section 12. From pump section 12, the fluid is transported out of section 12 as shown by the arrow at high pressure for further utilization.

Figure 6:
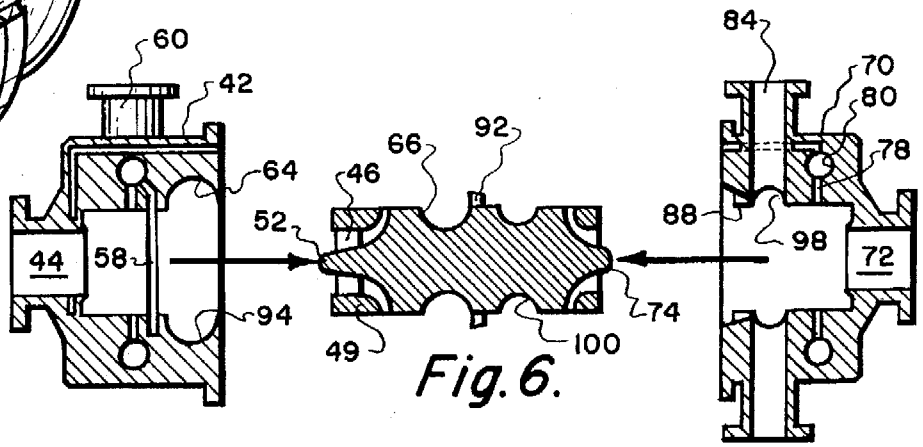
FIG. 6 is an exploded view of the turbopump assembly of FIG. 4.
Figure 4:
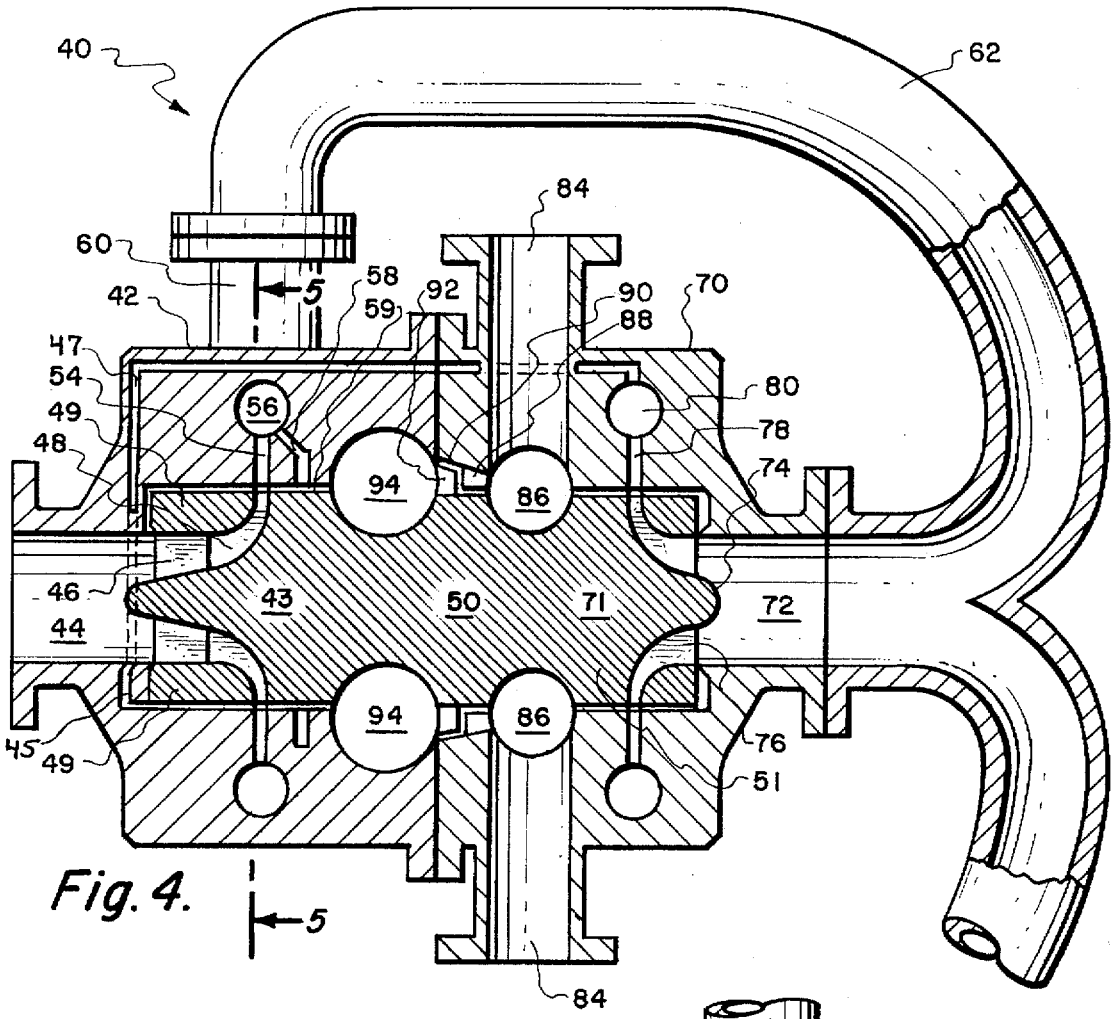
FIG. 4 is a cross-sectional view taken along line 4—4 of FIG. 2.
Figure 5:
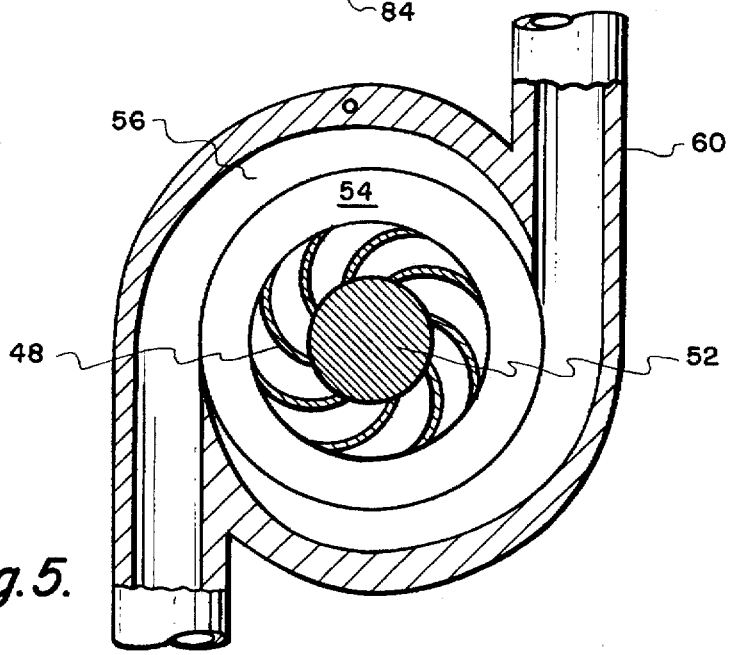
FIG. 5 is a cross-sectional view of one embodiment of the turbopump assembly taken along line 5—5 of FIG. 4.

With reference to the drawings, FIG. 4 depicts a turbopump assembly constructed in accordance with the present invention and designated generally as 40. Turbopump assembly 40 includes a first or forward pump section housing 42 and a second or aft pump section housing 70, each of which may be made of aluminum, titanium or high strength steel alloys or a plastic material suitable for the design requirements of assembly 40. In addition to housings 42 and 70, each of which have a uniform inside diameter, assembly 40 is further provided with rotor 51 as shown in FIGS. 4 and 6 having a uniform outside diameter to facilitate assembly.

Rotor 51 is positioned within housings 42 and 70 and in cooperation with said housings defines a first pump 43 within first pump section housing 42 and a second pump 71 within second pump section housing 70 and a center turbine 50 with manifolds 94 and 86. In other words, if the rotor and housings of FIG. 6 were assembled, then as shown in FIG. 4, the composite structure would provide a first or forward pump 43 and an aft pump 71 having first pump section fluid inlet 44 and second pump section inlet 72, respectively and a center turbine 50 with an inlet manifold 86 and an exit manifold 94.

Referring again to FIG. 4, the first or forward pump generally designated 43 includes an inlet 44, an inducer 46, an impeller 48, a diffuser 54, and a volute 56. Internal manifolds 94 defined by an internal surface 64 (see FIG. 6) of the first pump section housing 42 and external surface 66 of rotor 51 embody the turbine exhaust manifolds. In similar fashion, second pump generally designated 71 includes inlet 72, impeller 76, diffuser 78, and volute 80. Internal manifolds 86 defined by an internal surface 98 of the second pump housing 70 and external surface 100 of rotor 51 embody the turbine inlet manifold 86.

By this configuration, first or forward pump 43, second or aft pump 71, and center turbine 50 form an integrated turbine and dual pump turbopump configuration by utilizing the constant diameter of the one piece rotor and the profiles of the two housing pieces to make up the required fluid passages.

In order for working fluid to be processed by turbopump assembly 40, the first pump section housing 42 includes fluid inlet 44 which directs fluid past inducer 46 associated with forward impeller hub 52 of rotating shaft 51. The forward impeller hub 52 also includes pump impeller 48 attached thereto. Located within first pump section housing 42 is diffuser 54. Diffuser 54 communicates with volute collector 56 which in turn is associated with fluid passage 58 which supplies lubricating fluid to adjacent hydrostatic bearing/seal surfaces 59.

A forward volute discharge 60 is formed proximate volute collector 56 and via interpump crossover 62 allows for fluid communication between first pump 43 and second pump 71 defined by housing 42, housing 70 and rotor 51.

Second pump inlet 72 in the aft end of second pump section housing 70 as shown in FIG. 4 includes impeller hub 74 of rotor 51, second pump impeller 76, second pump diffuser 78 and second pump volute collector 80. Fluid from volute discharge 60 flows through interpump crossover 62, into inlet 72 and second pump 71.

Figure 2:
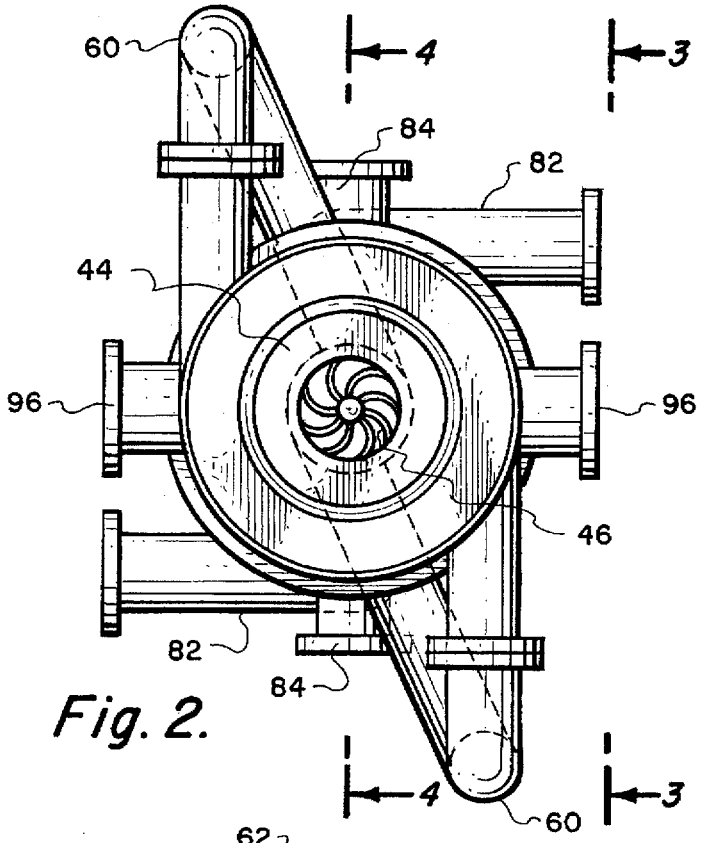
FIG. 2 is an end view of a turbopump assembly of the present invention.
Figure 3:
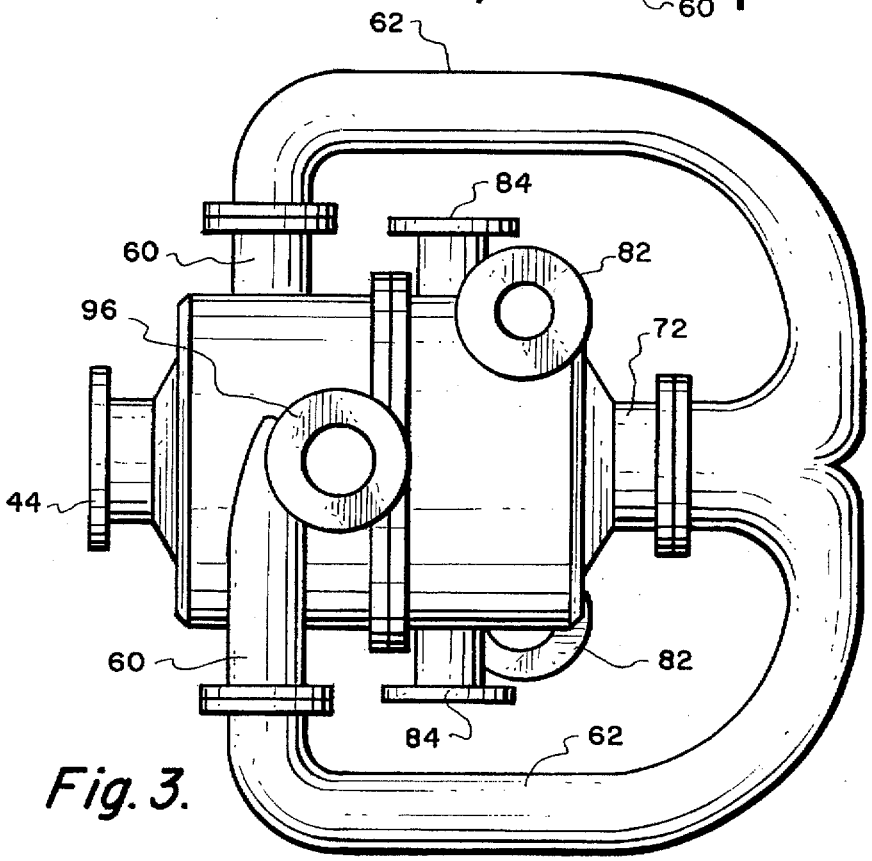
FIG. 3 is a side elevation view along line 3—3 of FIG. 2.

As will be explained in greater detail hereinbelow, volute collector 80 communicates with second pump volute discharge 82 (see FIGS. 2 and 3). The turbine inlet 84 communicates with inlet manifold 86 and stationary inlet nozzle vanes 88 attached to second pump section housing 70 to supply the working fluid to the turbine rotor blades 92. A chamber 90 is defined by second pump section housing 70 and rotor 51. Within chamber 90 as seen in FIG. 4, nozzle vanes 88 are positioned approximate to shaft rotor blades 92 which are attached to rotor 51. Chamber 90 also forms a conduit between inlet manifold 86 and the turbine exit manifold 94 of the forward pump housing 42. Exit manifold 94 then communicates with manifold outlet 96 (see FIG. 3) which directs the turbine working fluid out of turbopump assembly 40 to an end user such as a rocket engine thrust chamber.

In operation a fluid such as liquid hydrogen is supplied from a fuel system holding tank (not shown) to the first pump inlet 44 and gaseous high energy fluid is supplied to the turbine inlet 84.

The pump fluid enters the first pump section 43 through inlet duct 44, and passes into inducer 46, which enables the pump to operate at low inlet pressure. Then, the majority of the first pump section energy input occurs in impeller 48 converting mechanical torque to fluid angular momentum and static pressure. The excess kinetic energy, in the form of fluid velocity leaving the impeller is converted to static pressure in diffuser 54. The flow is then collected in volute collector 56, and directed into discharge ducts 60, which lead to pump section flow crossover ducts 62. The crossover ducts then merge and direct the flow into inlet 72. All of the second pump section energy input occurs in impeller 76. From there, the flow situation is analogous to that at the exit to the first pump section impeller, i.e., the flow is diffused in diffuser 78, collected in volute collector 80, and directed into discharge ducts 82 (which are shown in FIGS. 2 and 3). From there, the fluid is directed to a user system such as a rocket propulsion system.

A portion, or all of that pump flow is returned, after being heated by combustion and/or heat transfer, to drive the turbine. It enters the turbine as a moderately high temperature gas through turbine inlet ducts 84 (see FIG. 4), and passes into the turbine inlet manifold 86. Turbine nozzle blades 88 align that flow for efficient passage through the turbine rotor blades 92, which convert the kinetic energy in the nozzle exit flow to a torque that drives the two pump sections. After leaving the rotor blades, the flow is collected in turbine exit manifold 94, and delivered to turbine discharge ducts 96 (see FIGS. 2 and 3). From there, the flow is delivered, depending on the engine cycle, either to the main combustion chamber, or to a turbine exhaust thruster.

The roto 51 is supported, in the radial direction, by combined hydrostatic bearings/seals that are located on both sides of both impeller exits.

In conventional turbopumps, the rotor center of rotation is established by radial beatings and the concentricity of the impeller shroud and interstage seals must be maintained with respect to the bearings. By combining the function of the bearings and seals into the hydrostatic bearings located on both sides of the impeller discharge, concentricity control between bearings and seals is eliminated and normal differential pressure leakage is utilized to provide the hydrostatic bearing stiffness and damping. The hydrostatic bearing also acts as the dynamic seal to control the leakage rate between the pump section and the turbine section.

For the first pump section 43, the first of these combined bearings is located in the radial concentric space between the inducer/impeller shroud 49 and housing 42, which are at the uniform diameter of rotor 51 to facilitate assembly, and the second of these combined bearings is located on the other side of impeller 48, and is fed by flow that passes from volute collector 56 to secondary bearing supply 58. Flow from the secondary beating discharges into the diffuser 54 on the pump section side and into the turbine exhaust manifold 94 on the turbine section side, eliminating the need for dynamic seals and purges. The pumps can then be used for environmentally safe usages where no leaks are tolerated. Similar combined bearings support the radial loads in the second pump section 71 and are at the uniform diameter of rotor 51 to facilitate assembly.

The axial thrust loads are pressure balanced by the balance piston flow that is delivered to the radial face 45 outside of inducer 46 through the balance piston flow duct 47 that passes from second pump section volute 80 to the aforementioned radial face.

With this arrangement of turbopump components it is apparent that the housing consists of only three parts; first pump section housing 42, second pump section housing 70, and pump section crossover duct 62. The lack of housing radial penetration into rotor 51, to diameters less than those at the tips of impellers 48 and 76, permits this great simplification. It also permits the rotor 51 to consist of only one part. Finally, it maximizes the diameter of that rotating assembly, thereby eliminating flexural critical speeds from the turbopump operating range.

It is apparent that the uniform diameter of the first pump section, the turbine section, and the second pump section can be different and still retain the taught art of being able to assemble the first pump housing and the second pump housing on to the one piece rotor to make up the turbopump assembly.

Figure 7:
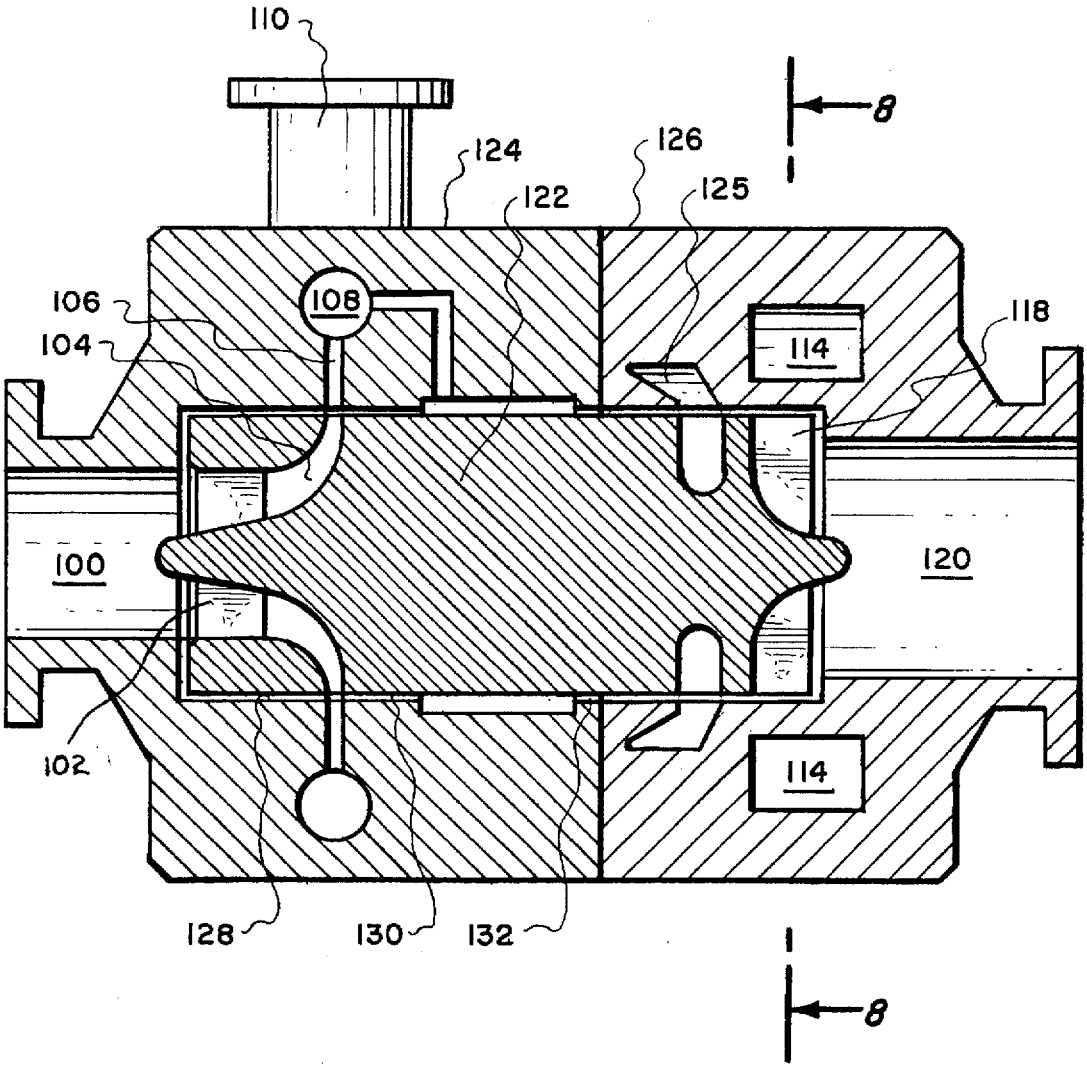
FIG. 7 is a cross-sectional view of a turbopump assembly having a single stage centrifugal pump and a radial inflow turbine, utilizing the present invention teachings.
Figure 8:
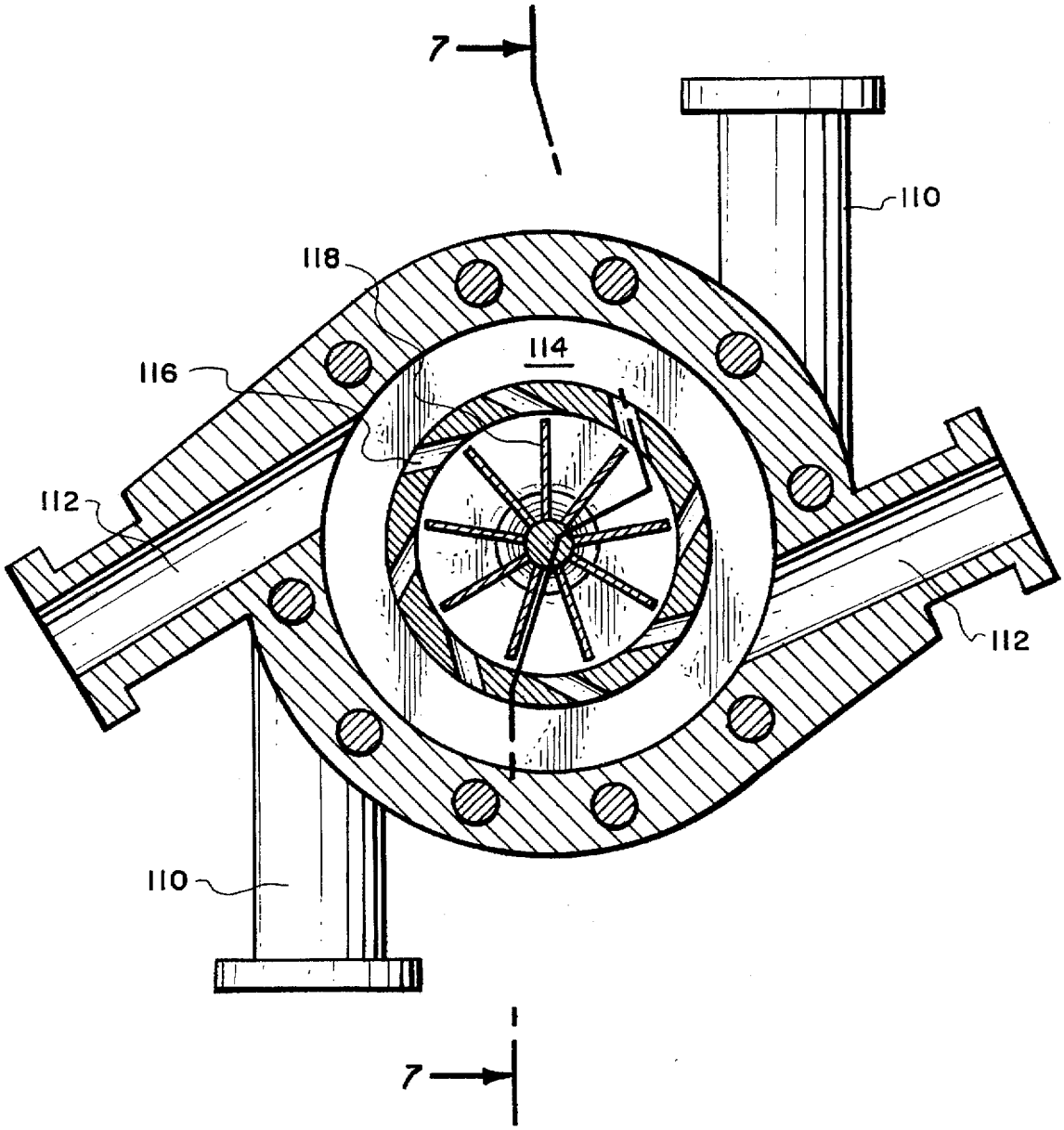
FIG. 8 is an end view along line 8—8 of FIG. 7.
Figure 8:
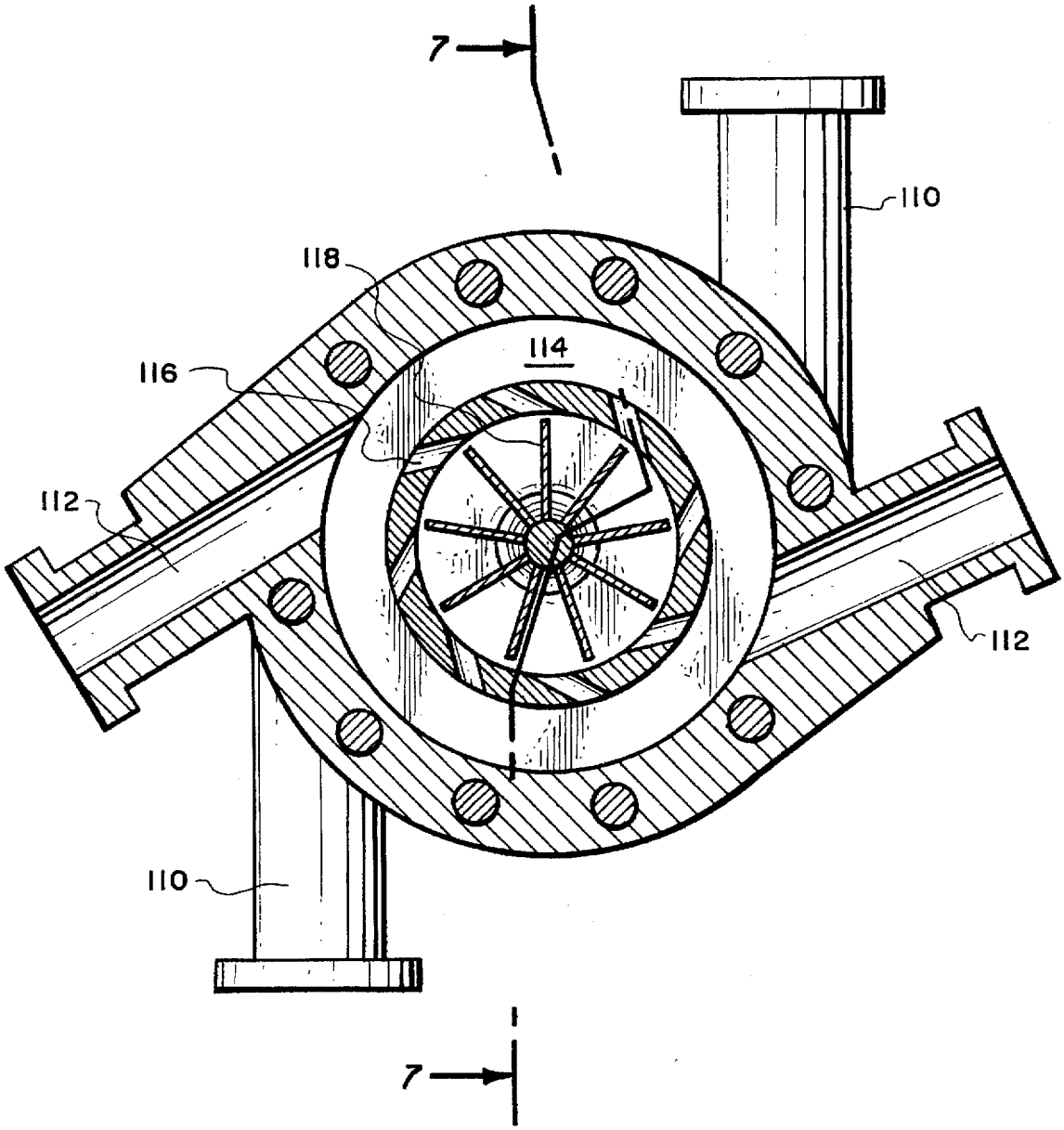
Figure 10:
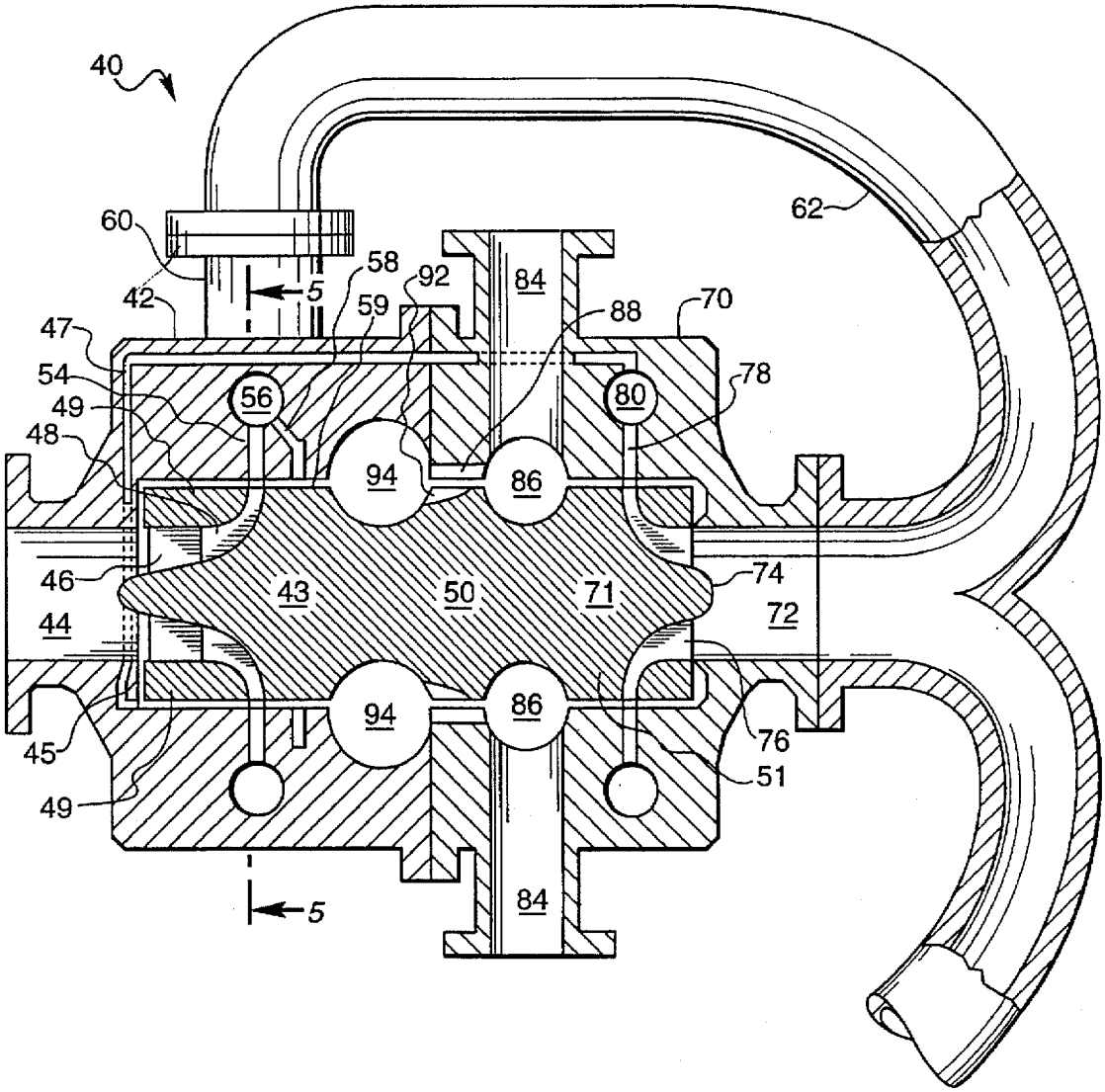
FIG. 10 is a cross section view as in FIG. 4 showing the uniform maximum diameter rotor embodiment.
Figure 11:
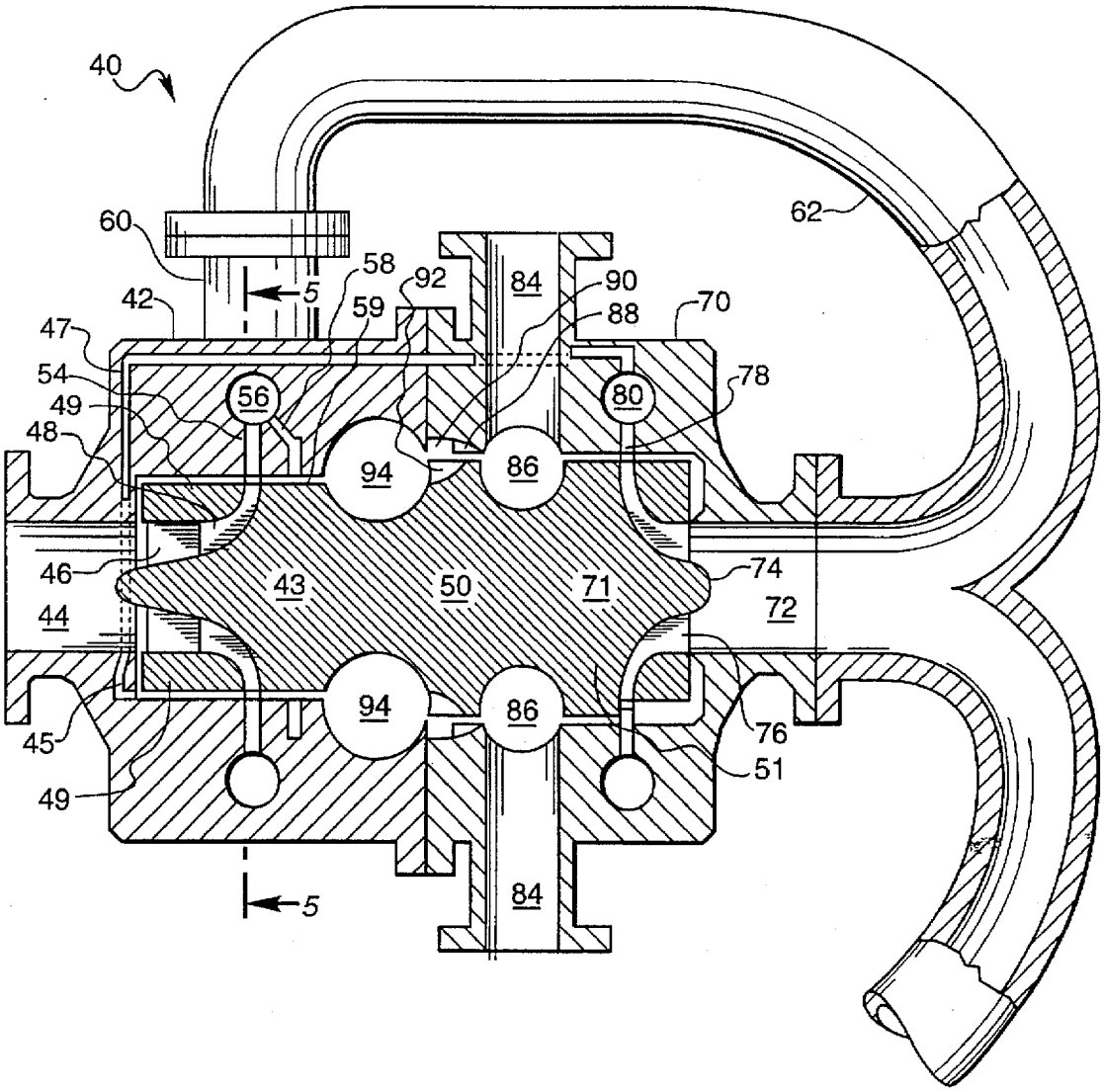
FIG. 11 is a cross section view as in FIG. 4 showing the different diameter second housing portion embodiment.

Alternate turbopump configurations to which this principle is applied are illustrated in FIGS. 7, 8, and 9. These configurations differ from that of FIG. 4 in that they only have one pump section (or stage) and, therefore, have their turbines on the other end of the shaft rather than in the middle. The configuration illustrated in FIGS. 7 and 8 has a radial inflow turbine, and that of FIG. 9 has an axial flow turbine. However, both configurations utilize the combined hydrostatic bearings and seals, and the principle of no housing radial penetration to a diameter of less than that of the pump impeller, to obtain the same high degree of simplicity, and the same resistance to critical speeds, as were obtained with the configuration in FIG. 4.

Similarly, as in the turbopump assembly depicted in FIG. 4, the turbopump assemblies shown in FIGS. 7–9 provide an inside diameter of the respective diffuser, collector and nozzle equal to or greater than the turbopump impeller tip. In addition the assemblies of FIGS. 7–9, as with the embodiment of FIG. 4, provide a minimum diameter, for each assembly diffuser, collector and turbine stators, equal to or greater than the impeller tip terminus.

In this manner the turbopump assemblies (FIGS. 1–9) exhibit a housing configuration that selectively precludes radial penetration by the aforementioned components into the rotor assembly of the turbopump assemblies.

Referring to FIGS. 7 and 8, fluid flow of the type discussed above, enters the pump through inlet 100 passes through inducer 102, which enables the pump to operate at low inlet pressure. Then, the bulk of the pump energy input to the flow occurs in impeller 104. Next, the flow passes into radial diffuser 106, where the fluid velocity is convened to static pressure. From there, the flow passes into volute collector 108, which directs it into the pump exit ducts 110.

To drive this pump, turbine drive gas enters the turbine through turbine inlet ducts 112, and passes into the turbine inlet manifold 114. It is directed at radial inflow turbine rotor 118, at the appropriate angle, by inlet nozzles 116 (see FIG. 8). As the flow passes radially inward, rotor 118 converts the kinetic energy in the drive gases into mechanical energy to drive the pump on the other end of shaft 122. The spent drive gases then exit the turbine axially through duct 120.

Shaft 122, which has the pump impeller on one end and the turbine rotor on its other end, is supported by combined hydrostatic bearings and seals 128, 130, and 132, that are located at the same uniform diameter as that of the pump impeller tip and the turbine rotor tip. Through this arrangement, the configuration in FIGS. 7 and 8 requires only three parts, the shaft/rotor/impeller 122, and housing parts 124 and 126. It thereby achieves the same simplicity and ruggedness that was exhibited by the configuration shown in FIG. 4.

Also shown in FIG. 7 is an annular gap 125 which thermally isolates the higher temperature turbine from the lower temperature pump during operation.

In the configuration shown in FIG. 9, the pump function is identical to that just discussed. The flow enters the pump through inlet 200 and passes through inducer 202, which enables the pump to operate at low inlet pressure. Then, the bulk of the energy input to the flow occurs in impeller 204. Next the flow passes into radial diffuser 206, where the fluid velocity is converted to static pressure. From there, the flow passes into volute collector 208, which directs it into a pump exit duct (not illustrated).

To drive this pump, the turbine drive gas enters the turbine through a turbine inlet duct (not shown) and passes into turbine inlet manifold 210, which aligns it and directs it into axial turbine rotor blades 212. These turbine rotor blades expand and convert the gas energy into mechanical energy to drive the pump through shaft 218. Upon leaving the rotor blades, the gases are diffused and turned axially by stationary stator vanes 214. The spent gases then leave the turbine through exit duct 216.

Shaft 218, which has the pump impeller on one end and the turbine rotor on its other end, is supported by combined hydrostatic bearings and seals 224, 226, and 228, that are located at the same uniform diameter as that of the pump impeller tip. Through this arrangement, the configuration of FIG. 9 consists of three parts, the shaft/rotor/impeller 218, and housing sections 220 and 222.

By combining the bearings and seal functions into a single unit and placing them at the same uniform diameter as that of the pump impeller tip(s), by placing the pump inlet(s) at the end of the shaft, and by making the diameters of the pump diffuser/collector and the turbine manifold nozzle equal to or greater than that of the pump impeller tip(s), the following features result:

(a) The housing that contains the diffusers, collectors, manifolds and nozzles can be made of only two parts that, when unbolted, can be slipped off the two ends of the rotating assembly.

(b) The rotating assembly that contains the shaft, the pump impeller(s), and the turbine rotor can be made of only one part.

(c) The above features translate into an overall turbopump assembly that consists of only four parts if there are two pump sections (as in FIG. 4), and only three parts if there is one pump section (as in FIGS. 7 and 9).

(d) The minimum diameters of the rotating assembly are maximized, thereby minimizing the possibility of operating at flexural critical speeds which, in turn, greatly enhances operational stability, range and reliability.

(e) It is also apparent that for a two stage pump as presented in FIG. 4, the tip diameter of the first stage impeller and its respective housing can be different than the tip diameter of the second stage impeller and its respective housing and still facilitate assembling the one piece rotor in the two piece housing.

The present invention may be embodied in other specific forms without departing from the spirit or essential attributes thereof, and accordingly, reference should be made to the appended claims as indicating the scope of the invention.

What is claimed:

1. A turbopump assembly comprising:

a housing having a first portion and a second portion with a parting plane therebetween to facilitate ease of assembly of the housing, the housing having a uniform maximum inside diameter, a one piece rotor having at least one pump section having impellers, and a turbine section having turbine blades, the rotor having a uniform maximum outside diameter, the impellers and turbine blades extending to the maximum outside diameter of the rotor, wherein the maximum outside diameter of the rotor is slightly smaller than the maximum inside diameter of the housing for ease of inserting the rotor in the housing, the housing having a hydrostatic bearing and seal portion, the hydrostatic bearing portion being proximate the rotor to radially support the rotor and prevent contact between the rotor and the housing while the rotor is rotating and the seal portion proximate the rotor preventing loss of a hydrostatic fluid.

2. A turbopump assembly as in claim 1 wherein, the one piece rotor has two pump sections with the turbine section therebetween.

3. A turbopump assembly as in claim 1 wherein, an inducer on the rotor provides a first fluid pumping step before the fluid engages the impeller.

4. A as in claim 1 wherein, the turbopump assembly includes an internal manifold defined by an internal surface of the housing having a diameter of greater than the maximum inside diameter of the housing and an adjacent external surface of the rotor having a diameter less than the maximum outside diameter of the rotor.

5. A turbopump assembly as in claim 1 wherein, a volute collector is located in the housing for collecting the fluid for discharge.

6. A turbopump assembly as in claim 1 wherein, a diffuser is located in the housing for converting fluid velocity to static pressure.

7. A turbopump assembly as in claim 1 wherein, a thermal insulation gap is placed in the housing near the turbine section to thermally insulate the pump section from the turbine section.

8. A turbopump assembly as in claim 2 wherein, the housing has a front end and a back end and the pump inlets are at the ends of the housing.

9. A turbopump assembly as in claim 2 wherein, a balance piston flow duct in the housing provides axial stability for the rotor.

10. A turbopump assembly comprising:

a housing having a first portion and a second portion with a parting plane therebetween to facilitate ease of assembly of the housing, a one piece rotor having at least two pump sections having impellers, and a turbine section having turbine blades between the two pump sections, the two pump sections of the rotor have different maximum outside diameters and the maximum inside diameter of the housing portions correspond to the maximum outside diameter of the rotors so that the rotor slides into the first portion and second portion of the housing unobstructed before the housing portions are attached, the housing having a hydrostatic bearing and seal portion, the hydrostatic bearing portion being proximate the rotor to radially support the rotor and prevent contact between the rotor and the housing while the rotor is rotating and the seal portion proximate the rotor preventing loss of a hydrostatic fluid.

11. A turbopump assembly comprising:

a housing having a first portion and a second portion with a parting plane therebetween to facilitate ease of assembly of the housing.

a one piece rotor having at least two pump sections having impellers, and a turbine section having turbine blades therebetween, the turbine section of the rotor has a different maximum outside diameter than at least one pump section and the maximum inside diameter of the housing portions correspond to the maximum outside diameter of the rotor so that the rotor slides into the first portion and the second portion of the housing unobstructed before the housing portions are attached, the housing having a hydrostatic bearing and seal portion, the hydrostatic bearing portion being proximate the rotor to radially support the rotor and prevent contact between the rotor and the housing while the rotor is rotating and the seal portion proximate the rotor preventing loss of a hydrostatic fluid.

12. A turbopump assembly as in claim 1, wherein the hydrostatic bearing and seal portion acts as the dynamic seal to control the leakage rate between the pump section and the turbine section.

13. A turbopump assembly as in claim 1, wherein the pump section and the turbine section are contained in the housing with only internal leakage between the pump section and the turbine section, whereby there is no external leakage of pumped fluids.

14. A turbopump assembly as in claim 10 wherein, the turbine section of the rotor has a different maximum outside diameter than at least one pump section and the maximum inside diameter of the housing portions correspond to the maximum outside diameter of the rotor so that the rotor slides into the first portion and the second portion of the housing unobstructed before the housing portions are attached.

* * * * *